US006347959B2

(12) United States Patent
Sawayanagi

(10) Patent No.: US 6,347,959 B2
(45) Date of Patent: Feb. 19, 2002

(54) BRACKET FOR ATTACHING INTERIOR EQUIPMENT

(75) Inventor: Masahiro Sawayanagi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/828,161

(22) Filed: Apr. 9, 2001

(30) Foreign Application Priority Data

Apr. 10, 2000 (JP) ..... 2000-108226

(51) Int. Cl.[7] ..... H01R 13/60; H01R 13/66; H01R 11/20; H01R 4/24; H01R 4/26

(52) U.S. Cl. ..... 439/537; 439/431; 439/351; 439/34; 439/801

(58) Field of Search ..... 439/439, 34, 35, 439/765, 781, 537, 351, 361, 567, 801, 521, 522

(56) References Cited

U.S. PATENT DOCUMENTS 3,760,330 A * 9/1973 Bennett et al. ..... 339/18
4,410,226 A * 10/1983 Adduci et al. ..... 339/44
4,550,965 A * 11/1985 Izraeli ..... 339/47
4,968,268 A * 11/1990 Oh ..... 439/411
5,266,057 A * 11/1993 Angel, Jr. et al. ..... 439/724
5,651,683 A * 7/1997 Shimamura et al. ..... 439/34
5,856,908 A * 1/1999 Takiguchi et al. ..... 361/690
5,939,672 A * 8/1999 Tang ..... 174/50.5
6,004,166 A * 12/1999 Cardas ..... 439/801
6,018,278 A * 1/2000 Tang ..... 333/100
6,151,980 A * 11/2000 Nishitani et al. ..... 74/484
6,244,884 B1 * 6/2001 Kerul ..... 439/262

FOREIGN PATENT DOCUMENTS

JP 64-22620 1/1989 ..... B60J/3/02

* cited by examiner

*Primary Examiner*—P. Austin Bradley
*Assistant Examiner*—Edwin A. León
(74) *Attorney, Agent, or Firm*—Sughrue Mion, PLLC

(57) ABSTRACT

A base member is attached to an interior wall member which covers an inner face of a vehicle body panel. A first power supply wire is arranged between the vehicle body panel and the interior wall member. A first terminal is provided on a leading end of the first power supply wire, and fixed on the base member so as to face inside of the vehicle. An insulative cover member is provided on the base member movably between an open position at which the first terminal is exposed and a close position at which the first terminal is covered. A bracket body is provided with an interior equipment of a vehicle, and engaged with the base member. A second power supply wire is led out from the interior equipment. A second terminal is provided on a leading end of the second power supply line, and fixed on the bracket body so as to oppose to the first terminal. A conductive screw pierces through the first terminal, the second terminal and the insulative cover member, for electrically connecting the first and second power supply wires, while securing the bracket body to the base member.

3 Claims, 7 Drawing Sheets

PRIOR ART

BRACKET FOR ATTACHING INTERIOR EQUIPMENT

BACKGROUND OF THE INVENTION

The present invention relates to a bracket for attaching an interior equipment, and more particularly to a bracket used for attaching, to a vehicle body panel, an interior equipment to which electric power is supplied via a wire harness disposed in a vehicle.

Heretofore, the interior equipments attached to a vehicle body panel through an interior wall member covering a back face of the vehicle body panel include some items to which electric power is supplied via the wire harness disposed in the vehicle.

For example, as for a sun visor to be attached to a roof above a front seat in a vehicle, there has been developed a sun visor having an illumination unit which is provided with, in addition to a vanity mirror, a lighting device incorporated for the use of this mirror.

FIG. 12 shows a related fitting structure for the sun visor having the illumination unit (for example, Japanese Patent Publication No. 64-22620A).

In this sun visor 21 having the illumination unit, a sun visor body 22 is provided with a mirror 3 as shown by a phantom line, and an illumination lamp for the use of this mirror 3. An electric wire 7 which is connected to the illumination lamp at its one end is passed through a shaft 23 which is attached to the sun visor body 22 at its one end. A contact (terminal) 26 is provided at an upper end of the shaft 23.

The upper end of the shaft 23 provided with the contact 26 is inserted into a hole formed in a bracket 25, and to a lower end of the shaft 23 attached to the sun visor body 22, there is connected a ground wire 11 for the illumination lamp.

On the other hand, to a roof trim 4*a* disposed on a roof 8 of the vehicle body is provided with a connector 24, which is so constructed as to be contained within a roof panel 4*b*. The connector 24 is formed with a recess 24*a* having a size capable of containing a projected portion of the bracket 25. A contact (terminal) 9*b* provided at one end of a power supply wire 9 is supported in the recess 24*a* by a coil spring 27 which is provided between the connector 24 and the contact 9*b*.

In order to attach the sun visor body 22, the projected portion of the bracket 25 is first inserted into the recess 24*a* in the connector 24. Then, the contact 26 of the electric wire 7 comes in contact with the contact 9*b* of the power supply wire 9, and these contacts 26 and 9*b* are electrically connected. On this occasion, since the contact 9*b* is urged by the coil spring 27 to be elastically abutted against the contact 26, the contact between the contacts 26 and 9*b* will be reliably conducted even though a slight assembling error exists.

Then, by fixing a fitting flange 23*a* of the bracket 25 to the roof trim 4*a* and the roof panel 4*b* by screwing a small screw 28, the ground wire 11 of the illumination lamp is earthed to the roof panel 4*b* by way of the shaft 23 and the bracket 25 allowing electricity to be supplied to the illumination lamp.

Therefore, because wiring connection of the sun visor 21 having the illumination unit can be effected only by inserting the shaft 23 into the connector 24, such connecting work as engaging the connector of contact 9*b* of the power supply wire 9 with the connector of the electric wire 7 is not required substantially, and the work will be easy. Also, there will be no need of drawing out the power supply wire 9 for the connecting work, and accordingly, an extra length of the power supply wire 9 can be reduced.

However, in the sun visor having the illumination unit as described above, when the bracket 25 has been detached from the recess 24*a* in the connector 24 for maintenance, the contact 9*b* to which the power is supplied via the power supply wire 9 is exposed to an inside of the vehicle.

In this state, there has been a probability that an electric shock is given when a tool or a finger happens to touch the contact 9*b* by mistake. In addition, when the exposed contact 9*b* is soiled with dirt or so, it has been probable that conductivity between the contact 9*b* and the contact 26 may be worsened on occasion of attaching the bracket 25.

There has been a further problem that in order to fix the bracket 25 of the sun visor 21 having the illumination unit to the roof trim 4*a* or the roof panel 4*b* by screw fitting, the projected portion of the bracket 25 must be kept inserted into the recess 24*a* in the connector 24 by one hand, and positioning of the small screw 28 and screwing operation must be conducted by the other hand, which deteriorates fitting workability.

SUMMARY OF THE INVENTION

In view of the above, an object of the invention is to solve the above described problems, and to provide an interior equipment fitting bracket which is free from accidents such as an electric shock, a short circuit, and deterioration of conductivity during maintenance of the interior equipment which is being supplied with electric power, and is excellent in attaching and detaching workability.

In order to achieve the above objects, according to the present invention, there is provided a bracket for attaching an interior equipment of a vehicle onto an interior wall member covering an inner face of a vehicle body panel, and supplying electric power to the interior equipment, comprising:

- a base member attached to the interior wall member;
- a first power supply wire, arranged between the vehicle body panel and the interior wall member;
- a first terminal provided on a leading end of the first power supply wire, and fixed on the base member so as to face inside of the vehicle;
- an insulative cover member, provided on the base member movably between an open position at which the first terminal is exposed and a close position at which the first terminal is covered;
- a bracket body, provided with the interior equipment, and engaged with the base member;
- a second power supply wire, led out from the interior equipment;
- a second terminal, provided on a leading end of the second power supply line, and fixed on the bracket body so as to oppose to the first terminal; and
- a conductive screw, piercing through the first terminal, the second terminal and the insulative cover member, for electrically connecting the first and second power supply wires, while securing the bracket body to the base member.

In this configuration, when the bracket body fastened to the interior equipment is detached, the first terminal of the first power supply wire is covered with the insulative cover member and will not be exposed to the inside of the vehicle. Therefore, accidents such as an electric shock and a short circuit when the tool or finger has happened to touch the terminal by mistake during the maintenance work, or deterioration of the conductivity caused by dirt adhered to the terminal will be eliminated.

Preferably, the insulative cover member is connected to the base member via a hinge, so as to be movable between the open position and the close position.

In this configuration, the first terminal can be easily detached from the base member by opening the insulative cover member, on occasion of the maintenance of the terminal connecting area.

Preferably, the bracket body includes a provisional engagement member for provisionally engaging the bracket body with the base member before the conductive screw is screwed.

In this configuration, there will be no need of supporting the bracket body by hand when the conductive screw is screwed, and the attaching workability will be enhanced.

DETAILED DESCRIPTION OF THE PREFERRED EMBODIMENTS

Now, a bracket for attaching an interior equipment according to one embodiment of the invention will be described in detail referring to the accompanying drawings.

Figure 1:
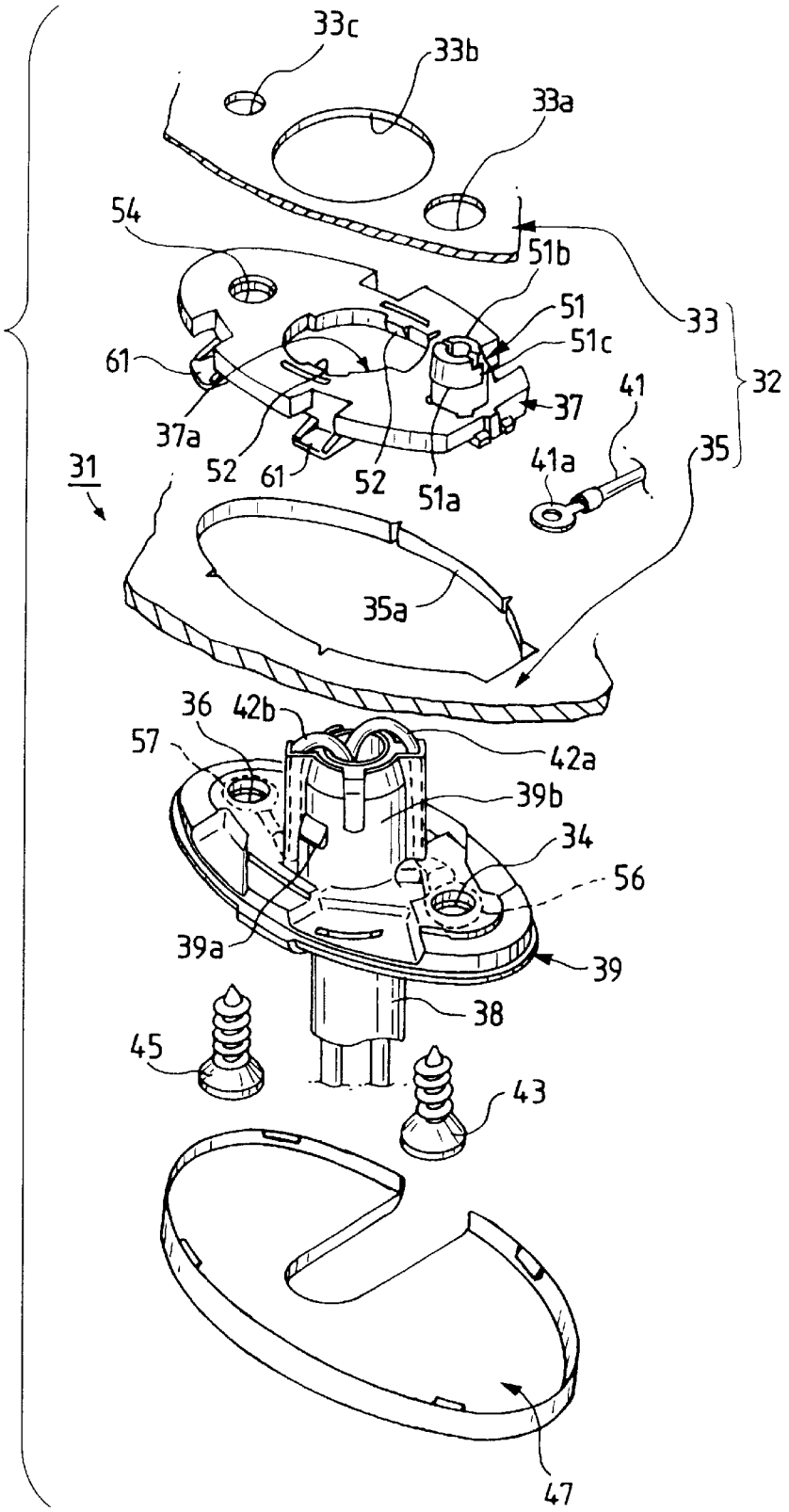
FIG. 1 is an exploded perspective view of a bracket for attaching an interior equipment according to one embodiment of the invention.

A bracket 31 according to the embodiment is a bracket for attaching a sun visor having an illumination unit to the vehicle body panel, and has a structure as shown in FIG. 1 consisting of: a roof panel 33 which is the vehicle body panel, a roof trim 35 which is an interior wall member assembled to the inside of the vehicle to cover a surface of the roof panel 33; a base member 37 interposed between the roof panel 33 and the roof trim 35; a bracket body 39 attached to one end of a shaft 38 attached to a sun visor body which is not shown in the drawing; a first and a second conductive screws 43, 45 for fixing these base member 37 and the bracket body 39 to the roof panel 33; and a cover 47 for covering a surface of the bracket 39 which faces inside of the vehicle.

Figure 2:
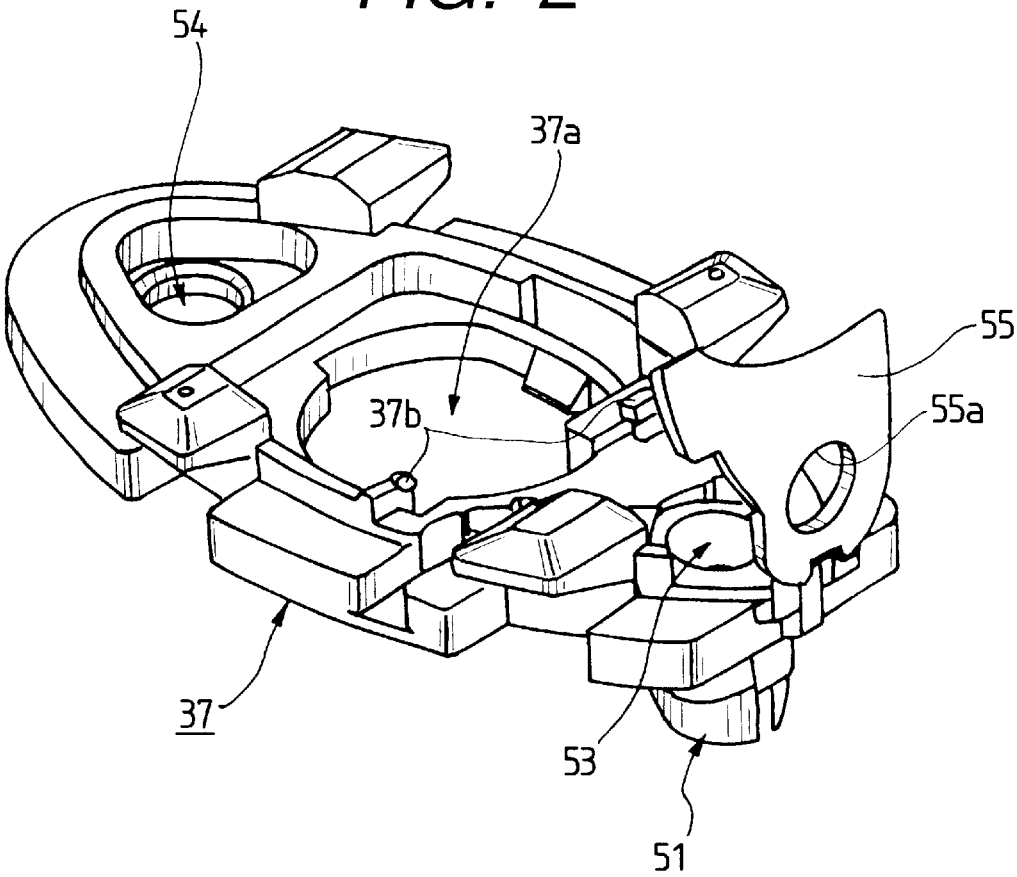
FIG. 2 is a perspective view of a base member as shown in FIG. 1 in its entirety as seen from an inside of a vehicle.
Figure 3:
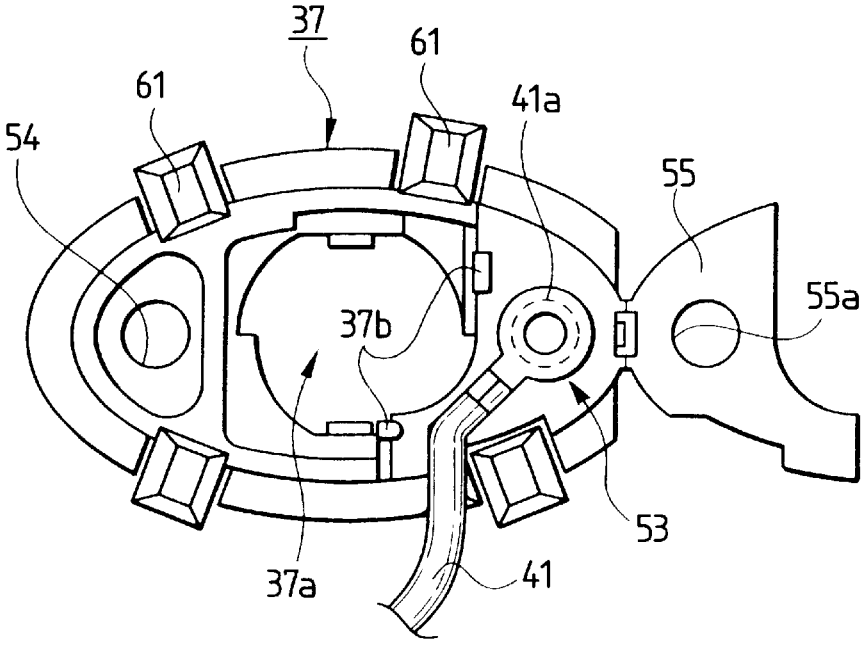
FIG. 3 is a front view of the base member as shown in FIG. 2 in a state where a terminal of a power supply wire has been set therein, as seen from the inside of the vehicle.

The base member 37 formed of insulating material such as synthetic resin has a grommet screw 51 which can be engaged in a fitting hole 33*a* formed in the roof panel 33. As shown in FIGS. 2 and 3, this grommet screw 51 is provided on its one face opposed to the bracket body 39 with a first conduction part 53 which is adapted to hold a terminal 41*a* of a power supply wire 41 arranged at a vehicle body side in a state where the terminal 41*a* is detachably covered with an insulating cover 55.

The insulating cover 55 is integrally molded with the base member 37 by way of a thin walled hinge, and adapted to cover an exposed face of the terminal 41*a* of the power supply wire 41 which has been positioned on the first conduction part 53 so as to be opened and closed from a side of the bracket body 39. The insulating cover 55 is provided with a hole 55*a* through which the first conductive screw 43 is adapted to pass.

Meanwhile, the base member 37 is provided with locking claws 37*b* for locking the insulating cover 55 in the closed state, at positions corresponding to the closing position of the insulating cover 55.

As shown in FIG. 1, the grommet screw 51 is in a shape of a substantially tubular projection which is press fitted in the fitting hole 33*a* formed in the roof panel 33, and composed of a pair of divided walls 51*a* and 51*b* which are-defined by slits longitudinally dividing a peripheral wall of the projection. In the illustrated embodiment, the divided wall 51*a* is a fixed wall having rigidity, while the divided wall 51*b* is a flexible wall having elasticity which is elastically displaceable in a radial direction (See FIGS. 9 and 10).

Moreover, as shown in FIG. 2, the grommet screw 51 having a through hole continued to the first conduction part 53 serves also as a screw-fitting portion for the first conductive screw 43. When the first conductive screw 43 is inserted into an inner periphery of the grommet screw 51, the divided wall 51*b* is elastically displaced so as to increase its diameter, whereby the grommet screw 51 is tightly fitted in the fitting hole 33*a*.

Because the divided wall 51*b* can be also elastically displaced so as to decrease its diameter, the base member 37 can be provisionally fastened to the roof panel 33 by press fitting the grommet screw 51 into the fitting hole 33*a*.

As shown in FIG. 1, at a center part of the base member 37, is formed an opening 37*a* through which a cylindrical portion 39*b* projected from a center of the bracket body 39 is adapted to pass. At a circumferential edge of the opening 37*a*, is provided temporary locking projections 52, which are adapted to be engaged with locking projections 39*a* projected from an outer periphery of the cylindrical portion 39*b* which are detachable with respect to the base member 37.

The base member 37 is further provided, at an opposite side to the grommet screw 51 interposing the opening 37*a*, with a screw passing hole 54 through which the second conductive screw 45 is adapted to pass. This screw passing hole 54 has a diameter which is larger than that of a thread of the second conductive screw 45.

Moreover, at an outer circumferential edge of the base member 37 in the described embodiment, there are provided trim lock 61 which are adapted to be engaged in a fitting opening 35*a* in the roof trim 35 to lock the base member 37 with the roof trim 35. The trim lock 61 are so designed as to hold an open edge of the fitting opening 35*a* by means of holding pieces integrally molded.

The bracket body 39 formed of insulative material such as synthetic resin or the like is provided with, as shown in FIG. 1, a second conduction part 34 in which a terminal 56 of a connecting wire 42*a* at a sun visor side is insert molded corresponding to the first conduction part 53, and a third conduction part 36 in which a terminal 57 of a ground wire 42*b* is insert molded corresponding to the screw passing hole 54, at both sides of the cylindrical portion 39*b* projected from the center.

In the illustrated embodiment, the terminals 41*a*, 56 and 57 are circular terminals respectively formed of circular plates for screw-fitting which are provided with screw insertion holes. An inner diameter of the screw insertion holes is made slightly smaller than an outer diameter of threaded portions of the conductive screws 43, 45, so that a reliable electric connection can be realized between the first and second conductive screws 43, 45 and the terminals 41*a*, 56 and 57, by screwing the first and second conductive screws 43, 45 into the screw insertion holes. An inner diameter of the screw-fitting hole 33*c* in the roof panel 33 to which the second conductive screw 45 is adapted to be inserted is also made slightly smaller than the outer diameter of the threaded portion of the second conductive screw 45. It is to be noted that the conductive screws 43, 45 are tapping screws which can cut threads in an engaging portion of a mating member.

Now, fitting steps in which the sun visor having the illumination unit is fitted to the vehicle roof 32 which includes the roof trim 35 covering the surface of the roof panel 33, by the bracket 31 according to this embodiment will be described.

Figure 4:
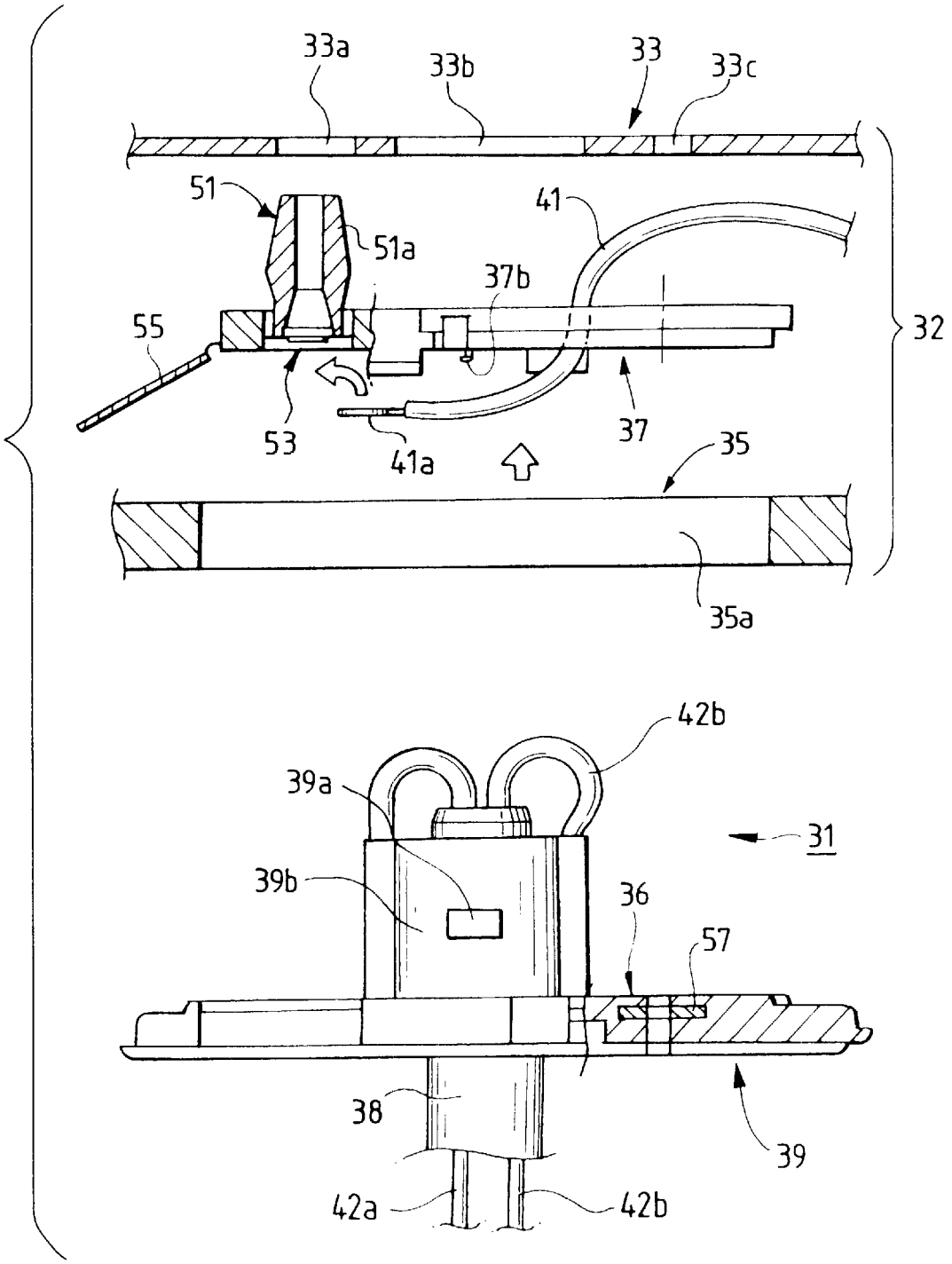
FIG. 4 is a longitudinally sectional view for explaining assembling steps of a bracket shown in FIG. 1.
Figure 5:
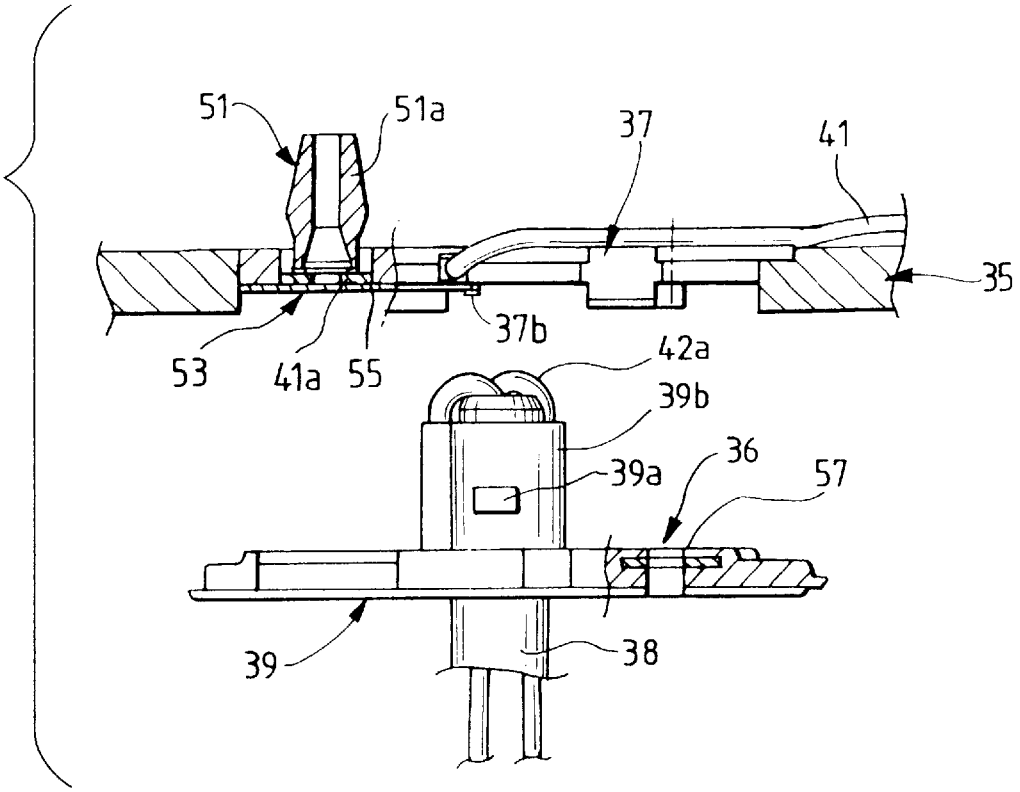
FIG. 5 is a longitudinally sectional view for explaining the assembling steps of the bracket shown in FIG. 1.
Figure 6:
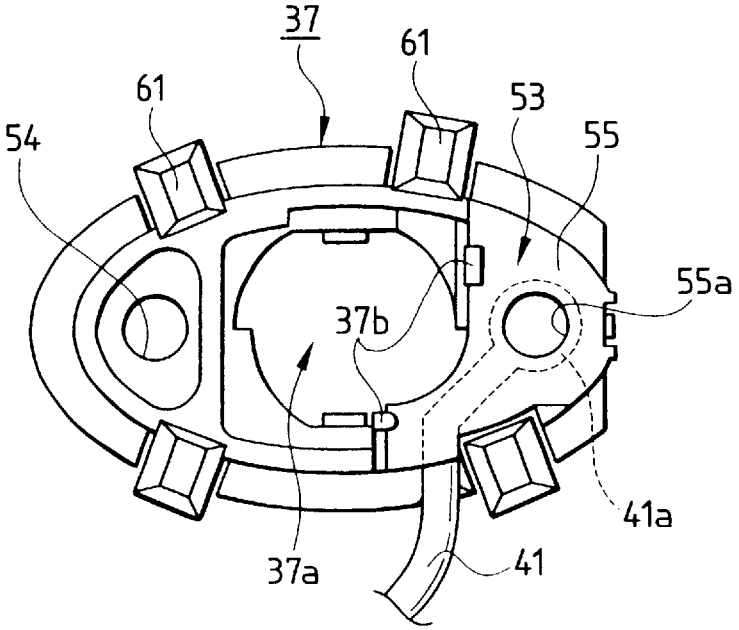
FIG. 6 is a front view of the base member as shown in FIG. 3 in a state where the terminal of the power supply wire has been received and held therein.

As a first step, as shown in FIG. 4, the terminal 41*a* of the power supply wire 41 arranged along an outer face of the roof trim 35 (a surface facing with the roof panel 33) is set on the first conduction part 53 of the base member 37, and positioned to be held by the insulating cover 55 as shown in FIG. 6. Thereafter, the base member 37 is fitted in the fitting opening 35*a* in the roof trim 35 by use of the trim lock 61, as shown in FIG. 5.

Figure 7:
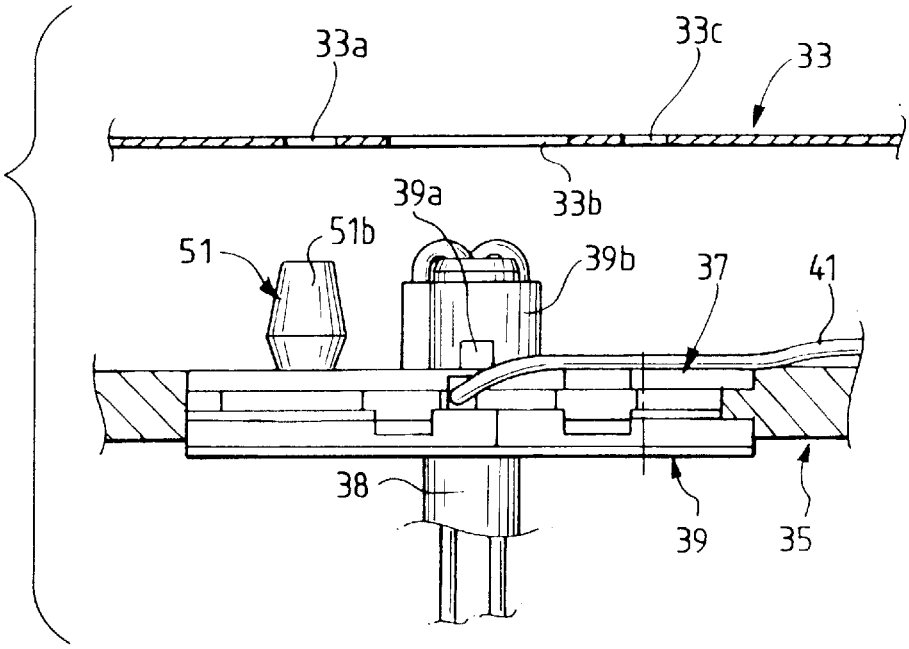
FIG. 7 is a longitudinally sectional view for explaining the assembling steps of the bracket shown in FIG. 1.

Then, as shown in FIG. 7, the cylindrical portion 39*b* of the bracket body 39 is inserted into the opening 37*a* of the base member 37, and by engaging the locking projections 39*a* formed at the outer circumference of the cylindrical portion 39*b* with the flexible elastic pieces 52 of the base member 37, the bracket body 39 is provisionally and detachably locked with the base member 37 which has been fitted to the roof trim 35.

Accordingly, the roof trim 35 in this embodiment can be treated as a roof module in which the sun visor having the illumination unit has been assembled in advance into a single unit by way of the bracket 31 (the base member 37 and the bracket body 39). Thus, troubles when the roof trim 35 is stored or assembled to the vehicle can be reduced.

Figure 9:
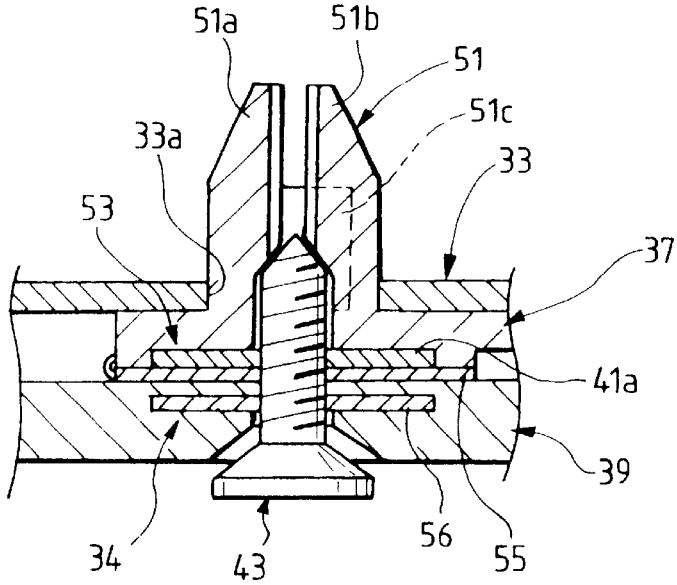
FIG. 9 is an enlarged sectional view of an essential part for illustrating an electrically connected state of the terminal of the power supply wire and a terminal of a connecting wire in the bracket shown in FIG. 1.
Figure 10:
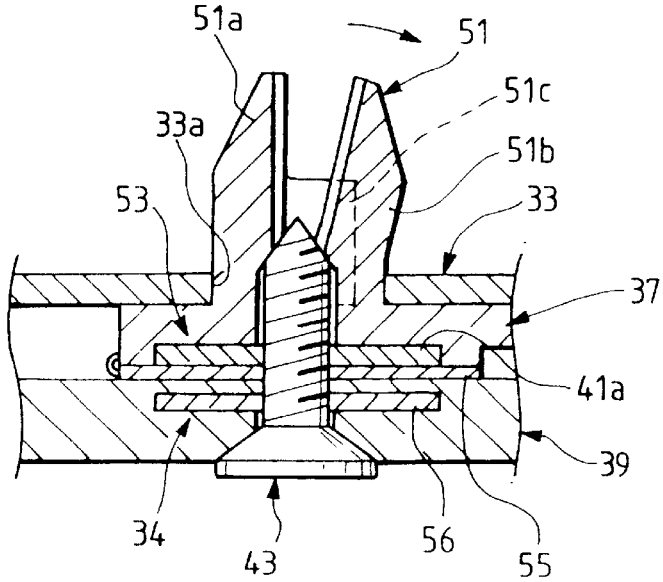
FIG. 10 is an enlarged sectional view of an essential part for illustrating the electrically connected state of the terminal of the power supply wire and the terminal of the connecting wire in the bracket shown in FIG. 1.

The roof trim 35 with which the sun visor having the illumination unit has been provisionally engaged by the bracket 31 is then fitted to the roof panel 33. On this occasion, the grommet screw 51 of the base member 37 is press fitted in the fitting hole 33*a* in the roof panel 33 as shown in FIG. 9 to conduct the engagement.

Figure 8:
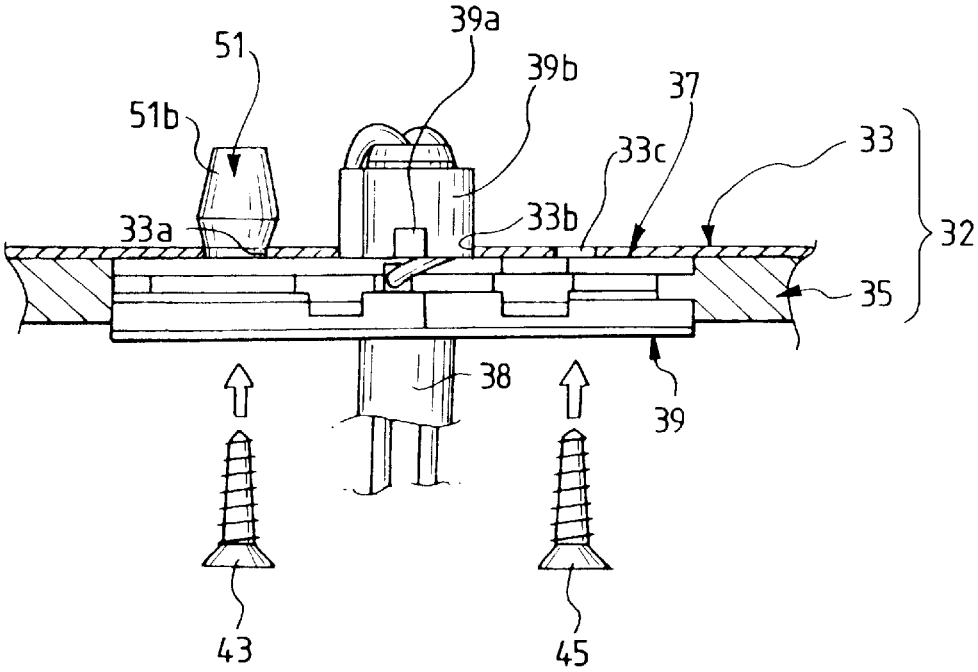
FIG. 8 is a longitudinally sectional view for explaining the assembling steps of the bracket shown in FIG. 1.

Thus, the roof trim 35 is brought in a provisional locking state to the roof panel 33 together with the bracket 31 by way of the grommet screw 51, as shown in FIG. 8. Therefore, there will be no need of supporting the bracket body 39 and the roof trim 35 by hand when the conductive screws 43, 45 are tightened to conduct a permanent fixation, and fitting workability will be improved.

Then, the bracket body 39 is permanently fixed to the roof panel 33 the conductive screws 43, 45.

On this occasion, when a tip end of the first conductive screw 43 is inserted into the grommet screw 51 passing through the first and the second conduction parts 53, 34 in the bracket body 39 and the base member 37, the divided wall 51*b* which is radially elastically displaceable is enlarged in diameter so that the grommet screw 51 is tightly fastened to the fitting hole 33*a* in the roof panel 33.

The first conductive screw 43 passed through the first and the second conduction parts 53, 34 is screwed into the screw insertion holes in the terminals 56, 41*a* while cutting the threads, so that the terminals 56, 41*a* can be conducted.

The grommet screw 51 in the form of a substantially cylindrical projection serves also as a screw-fitting portion which covers the tip end of the first conductive screw 43 which is protruded through the roof panel 33, when the terminal 41*a* of the power supply wire 41 and the terminal 56 of the connecting wire 42*a* are screw-fitted.

With this structure, the tip end of the first conductive screw 43 is abutted against the vehicle panel 33 when tightened, can pass through the fitting hole 33*a* without causing a short circuit, to reliably connect the terminals 56 and 41*a* to each other, and at the same time, can rigidly fix the bracket body 39 and the base member 37 to the vehicle panel 33.

In such a case where the tip end of the first conductive screw 43 will not come in contact with the vehicle panel 33 and has no possibility of the short circuit, the grommet screw 51 need not serve as the screw-fitting portion but can be formed separately.

Figure 11:
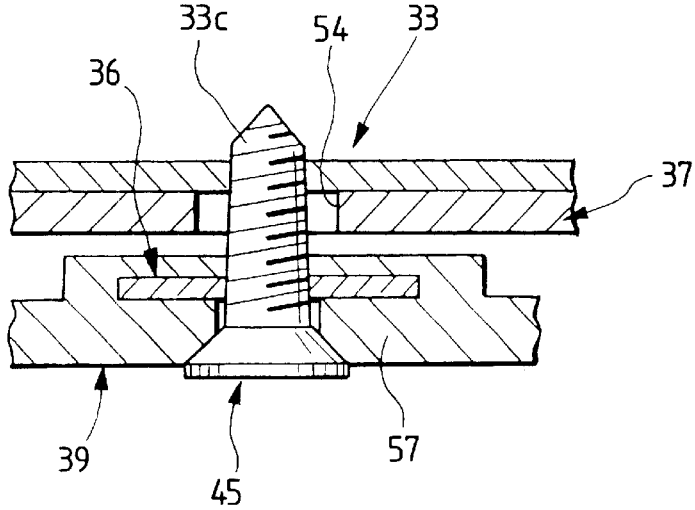
FIG. 11 is an enlarged sectional view of an essential part for illustrating an electrically connected state of a terminal of a ground wire and a vehicle body panel in the bracket shown in FIG. 1.
Figure 12:
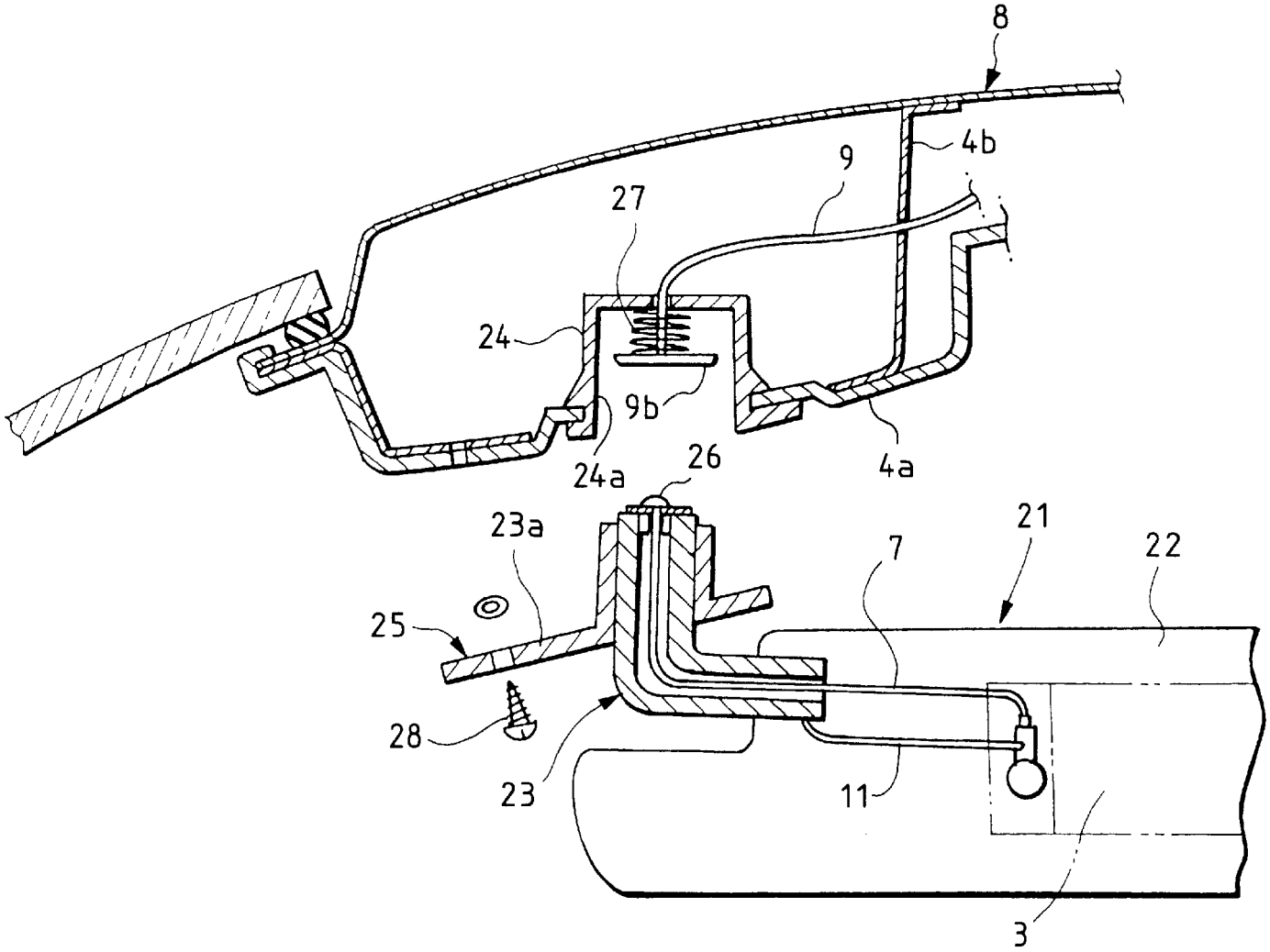
FIG. 12 is a longitudinal sectional view showing a related structure for attaching a sun visor having an illumination unit.

On the other hand, when the tip end of the second conductive screw 45 is passed through the third conduction part 36 of the bracket body 39 and the screw insertion hole 54 in the base member 37 and inserted in the screw-fitting hole 33*c* in the roof panel 33 while cutting threads as shown in FIG. 11, the terminal 57 of the ground wire 42*b* and the roof panel 33 can be conducted.

Thus, according to the bracket 31 in the above described embodiment, only by fixing the bracket body 39 to the base member 37 and the roof panel 33 by use of the first conductive screw 43 and the second conductive screw 45, the terminal 41*a* of the power supply wire 41 and the terminal 56 of the connecting wire 42*a* are conducted, and at the same time, the terminal 57 of the ground wire 42*b* and the roof panel 33 can be conducted.

In other words, there will be no need of the work for engaging the connectors for connecting the terminals of the power supply wire 41 and the connecting wire 42*a*, and the terminal of the ground wire 42*b* and the roof panel 33. In addition, high engaging accuracy is not required for the temporary locking member constituted between the bracket body 39 and the base member 37.

Further, the maintenance work for detaching the sun visor having the illumination unit from the vehicle roof 32 can be conducted only by detaching the bracket body 39 from the base member 37, releasing the lock between the bracket body 39 and the base member 37 by the engaging projections 39*a* and the flexible elastic pieces 52 which are the temporary locking member, after the conductive screws 43, 45 have been removed. The base member 37 holding the terminal 41*a* of the power supply wire 41 can be left at the side of the roof 32 by use of the grommet screw 51.

Thus, workability on occasion of the maintenance will be improved, because only few components are removed for the maintenance work, and no excessive tension will be applied to the power supply wire 41.

Therefore, high molding accuracy is not required for the bracket body 39 and the base member 37, and the manufacturing cost can be decreased. There will be no fear that inconveniences such as breakdown of the connectors and the electric wires may happen, and the bracket 31 which is cheap and excellent in the fitting workability can be provided.

When the bracket body 39 has been detached for the maintenance, the exposed face to the inside of the vehicle of the terminal 41*a* of the power supply wire 41 which is positioned at the first conduction part 53 is covered with the insulating cover 55 as shown in FIG. 6, and the terminal 41*a* of the power supply wire 41 which is being supplied with electric power will not be exposed to the inside of the vehicle.

Thus, accidents such as an electric shock or a short circuit caused by the tool or finger which has happened to touch the terminal 41*a* by mistake during the maintenance work can be prevented, and deterioration of the conductivity caused by dirt adhered to the terminal 41*a* can be eliminated.

Moreover, since the terminal 41*a* is covered with the insulating cover 55 by way of the thin walled hinge so as to be opened and closed, the terminal 41*a* can be easily detached from the first conduction part 53 by opening the insulating cover 55, on occasion of the maintenance of the terminal connecting area.

Therefore, the accidents such as the electric shock or short circuit, and deterioration of the conductivity can be prevented during the maintenance of the sun visor having the illumination unit which is being supplied with the power, and the bracket 31 having excellent fitting workability for the maintenance can be provided.

It is to be noted that the interior equipment fitting bracket according to the invention is not limited to the bracket 31 for the sun visor having the illumination unit in the above described embodiment, but can be applied to interior equipment fitting brackets for fitting other items of the interior equipment such as a room lamp unit, a rear combination lamp unit, etc. to the vehicle body panel.

Further, the specific structure of the above described insulating cover 55 is not restricted to the structure in the above described embodiment, but various modifications can be adopted according to the shape and the structure of the terminal for the power supply wire.

What is claimed is:

1. A bracket for attaching an interior equipment of a vehicle onto an interior wall member covering an inner face of a vehicle body panel, and supplying electric power to the interior equipment, comprising:

a base member attached to the interior wall member;

a first power supply wire, arranged between the vehicle body panel and the interior wall member;

a first terminal provided on a leading end of the first power supply wire, and fixed on the base member so as to face inside of the vehicle;

an insulative cover member, provided on the base member movably between an open position at which the first terminal is exposed and a close position at which the first terminal is covered;

a bracket body, provided with the interior equipment, and engaged with the base member;

a second power supply wire, led out from the interior equipment;

a second terminal, provided on a leading end of the second power supply line, and fixed on the bracket body so as to oppose to the first terminal; and a conductive screw, piercing through the first terminal, the second terminal and the insulative cover member, for electrically connecting the first and second power supply wires, while securing the bracket body to the base member.

2. The bracket as set forth in claim 1, wherein the insulative cover member is connected to the base member via a hinge, so as to be movable between the open position and the close position.

3. The bracket as set forth in claim 1, wherein the bracket body includes a provisional engagement member for provisionally engaging the bracket body with the base member before the conductive screw is screwed.

* * * * *